US009833024B2

(12) United States Patent
Neng

(10) Patent No.: US 9,833,024 B2
(45) Date of Patent: Dec. 5, 2017

(54) WIRE CASING AND METHOD OF MAKING THE SAME

(75) Inventor: Mo Shi Neng, Zhong Shan (CN)

(73) Assignee: LUEN HING TEXTILE (ZHONG SHAN) CO., LTD., Zhong Shan, Guangdong (CN)

( * ) Notice: Subject to any disclaimer, the term of this patent is extended or adjusted under 35 U.S.C. 154(b) by 790 days.

(21) Appl. No.: 13/419,909

(22) Filed: Mar. 14, 2012

(65) Prior Publication Data

US 2013/0052914 A1 Feb. 28, 2013

Related U.S. Application Data

(60) Provisional application No. 61/529,550, filed on Aug. 31, 2011.

(51) Int. Cl.

| | |
|---|---|
| ***A41C 3/12*** | (2006.01) |
| ***D05B 35/02*** | (2006.01) |
| ***D05B 35/06*** | (2006.01) |

(52) U.S. Cl.

CPC ..... *A41C 3/122* (2013.01); *D05B 35/02* (2013.01); *D05B 35/06* (2013.01)

(58) Field of Classification Search

CPC ..... A41C 3/12; A41C 3/14; A41C 3/0007; A41C 3/128

USPC ..... 450/52, 1, 41

See application file for complete search history.

(56) References Cited

U.S. PATENT DOCUMENTS 3,252,460 A * 5/1966 Lances ..... A41C 3/0007 450/49
3,704,713 A * 12/1972 Hopper ..... A41C 3/0007 450/52
4,203,449 A * 5/1980 Winzelberg ..... 450/49
5,669,247 A * 9/1997 McCartney ..... A41C 3/0007 450/49
6,190,232 B1 2/2001 Boser
7,032,626 B2 * 4/2006 Glenn et al. ..... 139/426 R (Continued)

FOREIGN PATENT DOCUMENTS

CN 2294973 Y 10/1998
CN 1215104 A 4/1999

(Continued)

OTHER PUBLICATIONS

International Search Report dated Dec. 13, 2012, for International Patent Application No. PCT/CN2012/080822.

(Continued)

*Primary Examiner* — Clinton T Ostrup
*Assistant Examiner* — Brieanna Szafran
(74) *Attorney, Agent, or Firm* — Karceski IP Law, PLLC

(57) ABSTRACT

An encased wire for a garment includes a wire with first and second ends and a casing surrounding the wire. The casing includes a first fabric ribbon woven from a polyamide that resists penetration by at least one of the ends of the wire. The casing has a first edge, a second edge, and a first, stitched seam disposed adjacent to the first edge to close the casing, thereby containing the wire. The casing may be a single layer construction or a multi-layer construction. Selected regions of the casing resist penetration by the wire. Other selected regions provide increased comfort to the wearer. A sewing machine and a method of manufacture of the casing also are provided.

18 Claims, 14 Drawing Sheets

(56) References Cited

U.S. PATENT DOCUMENTS

| | | | | |
|---|---|---|---|---|
| 7,207,861 | B2 * | 4/2007 | Martini | 450/49 |
| 7,392,666 | B2 * | 7/2008 | Namiki | A44C 5/0061 59/80 |
| 2004/0014393 | A1 | 1/2004 | Chan | |
| 2004/0142629 | A1 * | 7/2004 | Rabinowicz | A41C 3/00 450/1 |
| 2004/0192165 | A1 | 9/2004 | Falla et al. | |
| 2005/0124261 | A1 | 6/2005 | Martini | |
| 2009/0291617 | A1 * | 11/2009 | Wong | A41C 3/144 450/57 |
| 2010/0166832 | A1 * | 7/2010 | Ingle et al. | 424/443 |
| 2010/0317258 | A1 | 12/2010 | Liu | |
| 2011/0034105 | A1 | 2/2011 | Boser | |
| 2011/0262677 | A1 * | 10/2011 | Joyce | A41H 27/00 428/43 |

FOREIGN PATENT DOCUMENTS

| | | | |
|---|---|---|---|
| CN | 1395891 | A | 2/2003 |
| CN | 1557236 | A | 12/2004 |
| CN | 201560303 | U | 8/2010 |
| GB | 2489223 | A * | 9/2012 |
| WO | WO 03049529 | A2 | 6/2003 |

OTHER PUBLICATIONS

Chinese Office Action dated Feb. 28, 2015, for Chinese Patent Application No. 201280042170.5.

European Office Action dated Mar. 19, 2015, for European Patent Application No. 12826842.2.

Extended European Search Report dated Jul. 10, 2015, for European Patent Application No. 12826842.2.

Chinese Office Action dated Dec. 30, 2015, for Chinese Patent Application No. 201280042170.5.

Chinese Office Action dated Sep. 21, 2016, for Chinese Patent Application No. 201280042170.5.

European Office Action dated Jun. 20, 2016, for European Patent Application No. 12826842.2.

Chinese Office Action dated Jun. 9, 2017, for Chinese Patent Application No. 201280042170.5.

* cited by examiner

WIRE CASING AND METHOD OF MAKING THE SAME

CROSS-REFERENCE TO RELATED APPLICATION(S)

This Non-Provisional U.S. Patent Application relies for priority on U.S. Provisional Patent Application Ser. No. 61/529,550, which was filed on Aug. 31, 2011, the contents of which are incorporated herein by reference.

FIELD OF THE INVENTION

The present invention relates to a tubular fabric, a method of making the tubular fabric, an encased wire, and to articles manufactured therefrom, particularly underwired garments such as brassieres.

DESCRIPTION OF RELATED ART

It is known to produce fabric tubing for receiving a curved underwire. The term "underwire" is intended to include any substantially rigid structural member, and it need not be made from a metal. Other materials include plastics, metal composites, non-metal composites, and materials combining any of the foregoing, among other materials.

A considerable problem with known fabric tubing for underwires is that the ends of the underwires can penetrate the tubing, either during the course of garment manufacture or in use by a wearer.

At present, a significant proportion of brassiere ("bra") manufacturer's products are returned because of the underwire has a tendency to protrude through the fabric tubing after a period of time. As should be understood, product failure as a result of underwire protrusion can have a deleterious effect on customer satisfaction. Specifically, after the underwire protrudes from the fabric tubing, the customer no longer wishes to wear the garment.

A feature of conventional tubular fabric includes a fusible yarn that is arranged within the fabric tube so that the fusible yarn is capable of forming a penetration barrier. Specifically, the fusible yarn may be heated (among other types of treatments) to facilitate fusing. Once fused, the final material confers the advantage that the tubular fabric product will not deteriorate on washing in a washing machine, for example.

While fusible yarn materials offer advantages, they also present disadvantages. Specifically, after the fusible yarn is melted to provide a penetration barrier, the tubular fabric displays the following undesirable characteristics: (1) the fused fabric material no longer is as soft as the original material, (2) the fused material has a more stiff feel, which is less comfortable to wearers, and (3) the sides of the internal tube will more easily adhere to one another, which hinders insertion of the wire into the tube, thereby increasing manufacturing costs.

Consequently, the fusible fabric material of the prior art is more stiff, less comfortable, increases production costs, and reduces production efficiency.

SUMMARY OF THE INVENTION

The present invention seeks to avoid the difficulties and problems associated with the prior art, among other advantages and improvements as should become apparent from the discussion herein.

Specifically, with increased customer sophistication, there has developed an increased preference for products that minimize or eliminate the disadvantages associated with prior art underwire construction(s). To this end, there is an increasing trend to move away from conventional wire casing materials and constructions. Specifically, there is an increasing trend to move away from fusible fabric materials.

The present invention breaks away from the traditional approach to underwire materials and construction. Among other advances, the present invention relies upon modified sewing machines and devices to sew tubular fabric to form an improved wire casing that minimizes or eliminates the disadvantages noted with respect to the prior art.

In one embodiment, the present invention avoids reliance on fusible yarns, which are used in conventional wire casings. This eliminates (or at least minimizes) the creation of underwires for brassieres with a stiff feel and construction.

As such, it is one aspect of the present invention to provide an encased wire for a garment that includes a wire with first and second ends, and a casing surrounding the wire. The casing includes a first fabric ribbon woven from a polyamide that resists penetration by at least one of the ends of the wire. The casing also has a first edge, a second edge, and a first, stitched seam disposed adjacent to the first edge to close the casing, thereby containing the wire.

In one contemplated embodiment of the present invention, the fabric ribbon is folded along a fold line and the fold line defines the second edge of the casing.

In another embodiment, a second seam is disposed adjacent to the second edge.

In still another contemplated embodiment, the casing includes a second fabric ribbon woven from a polyamide that resists penetration by at least one of the ends of the wire and a second, stitched seam disposed adjacent to the second edge. In this embodiment, the first and second fabric ribbons are connected to one another via the first and second stitched seams adjacent to the first and second edges.

The present invention also contemplated that the defines first and second woven regions, the second woven regions being adjacent to the first and second edges, the first woven region being between the second woven regions, the first woven region being resistant to penetration by at least one of the ends of the wire, the second woven regions providing increased comfort to a wearer of a garment incorporating the encased wire. If so, the woven density of the first woven region is greater than the woven density of the second woven region.

It is also contemplated that the encased wire may include a third fabric ribbon disposed atop and attached to the first fabric ribbon, the third fabric ribbon being provided for contact with skin of a wearer of a garment incorporating the encased wire, the third fabric ribbon providing increased comfort to the wearer.

Still further, the encased wire may have a fourth fabric ribbon disposed atop and attached to the second fabric ribbon, the fourth fabric ribbon being provided thr contact with skin of a wearer of a garment incorporating the encased wire, the fourth fabric ribbon providing increased comfort to the wearer.

It is contemplated that the polyamide to be employed for the present invention is nylon.

It is also contemplated that the casing is made from polyamide and a polyurethane-polyurea copolymer. If so, the polyamide may be nylon and the polyurethane-polyurea copolymer may be spandex.

Further, the casing may be made from 95.6% nylon and 4.4% spandex. Alternatively, the casing may be made from 96.8% nylon and 3.2% spandex.

In another contemplated embodiment, the casing may be made from a material that wicks moisture.

The encased wire of present invention is considered to be suitable for an underwire for a brassiere.

The present invention also encompasses a sewing machine that includes a needle, and a casing guide disposed upstream of the needle. The casing guide is essentially U-shaped to fold a fabric ribbon onto itself along a fold line defined thereby.

The sewing machine also may include at least one feeding reel disposed upstream of the casing guide to deliver the fabric ribbon to the casing guide.

Still further, the sewing machine may include at least one alignment device disposed between the feeding reel and the casing guide to orient the fabric ribbon prior to being fed into the casing guide.

The present invention also encompasses a method for forming a casing for a wire. The method includes the steps of attaching a first fabric ribbon to a second fabric ribbon to form an intermediate ribbon, wherein the first fabric ribbon is configured to resist penetration by the wire and the second fabric ribbon is finished suitably for contact with a wearer's, attaching two intermediate ribbons to one another such that the first fabric ribbons face one another, thereby forming a pre-sewn casing, folding the pre-sewn casing into a predetermined orientation whereby the second fabric ribbon forms an exterior surface thereof, and sewing the pre-sewn casing to form the casing.

It is contemplated that the method also may include inserting the wire into the casing to form an encased wire.

Other aspects of the present invention will be made apparent from the discussion that follows.

BRIEF DESCRIPTION OF THE DRAWINGS

The present invention will now be described in connection with the drawings appended hereto, in which.

DETAILED DESCRIPTION OF EMBODIMENTS OF THE INVENTION

The present invention may be implemented using a variety of construction techniques and materials. Any discussion of particular materials, etc., is intended to be exemplary of the wide scope of the present invention. In other words, the present invention should not be understood to be limited to any of the specific materials that are discussed in the examples and embodiments that are provided herein.

Figure 1:
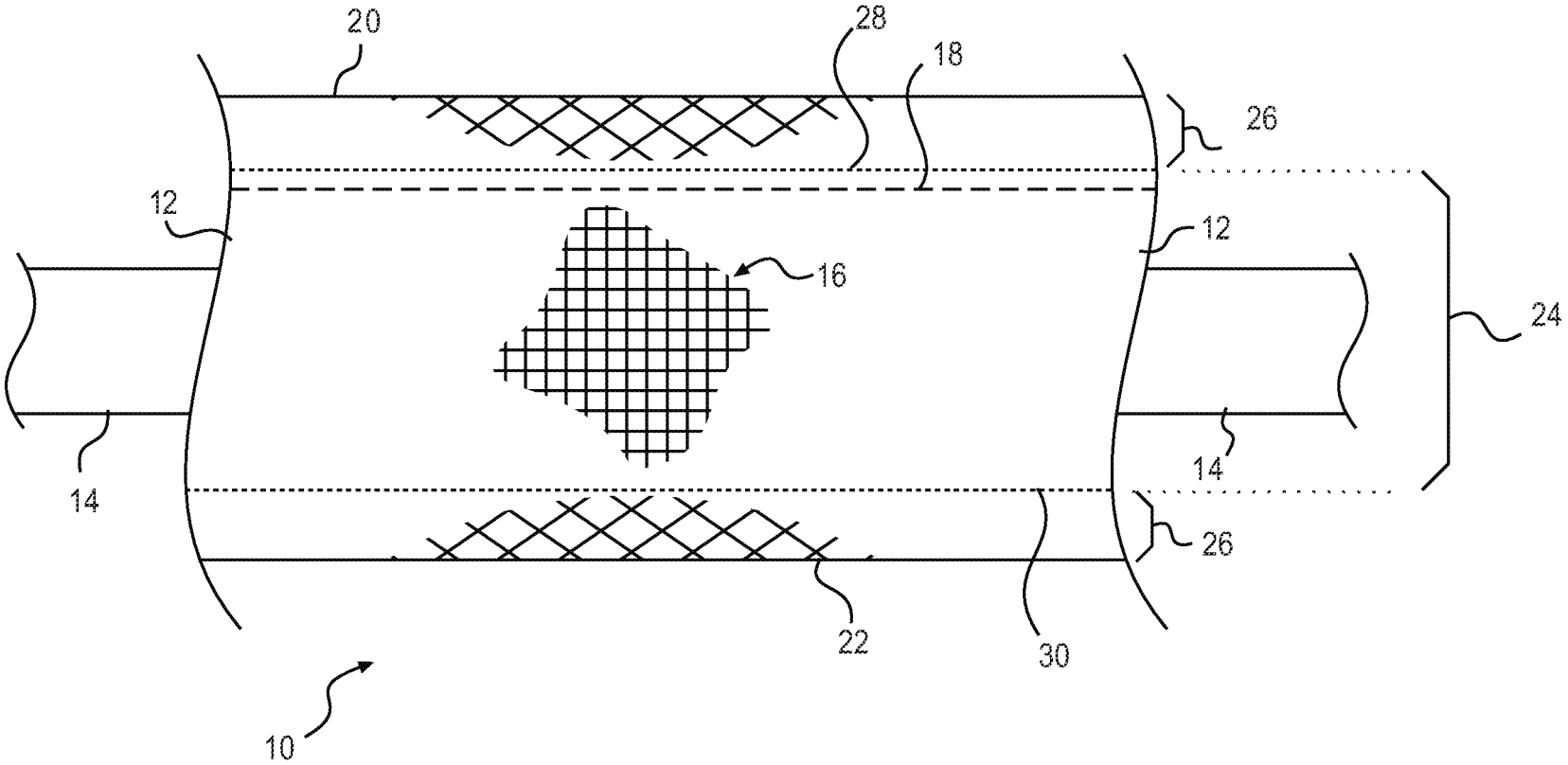
FIG. 1 is a top view of a first embodiment of a casing for an underwire according to the present invention.

FIG. 1 is an illustration of one contemplated embodiment of an encased wire 10 according to the present invention (also referred to as an "encased underwire" herein). The encased wire 10 includes a casing 12 that surrounds an underwire 14.

In the illustrated embodiment, the casing 12 is made from a woven fabric material, as indicated by the woven pattern 16 designated on the casing 12 shown in FIG. 1. While a woven fabric 16 may comprise the casing 12, it is contemplated that the casing 12 alternatively may be made from a non-woven material without departing from the scope of the present invention.

With respect to the embodiment illustrated in FIG. 1, the basic yarn that forms the casing 12 encapsulating the underwire 14 is a combination of nylon and spandex. More specifically, the yarn that forms the casing 12 is made from 95.6% nylon and 4.4% spandex.

An alternative material contemplated for the casing 12 is made of 96.8 nylon and 3.2% spandex. In this alternative embodiment, the material for the casing 12 may include a warn yarn (source, dtex, and filament count) designated as 78/24F/2 Twist Polyamide and/or 78/24F/1 Polyamide, with an elastomer (source, dtex) with a designation 311 Spandex covered by 44/1 Polyamide, and a weft yarn (dtex and filament count) having a designation 78/18F/1 Twist S.D Polyamide. The total width of the casing 12 is contemplated to be about 10 mm. The elongation of the material is contemplated to be about 20%.

As a point of reference, nylon is known as a thermoplastic material. In particular, the term "nylon" designates a family of synthetic fibers, generally known as polyamides. Spandex also is a synthetic fiber with well-known elastic properties. Spandex is generally known as a polyurethane-polyurea copolymer. The use of the terms "nylon" and "spandex" is not intended to be limiting of the present invention. To the contrary, use of these terms is intended to refer to the broad class of materials identified.

Nylon is considered to be an acceptable material for the primary component of the fabric 16, because nylon is understood to lie flat against the underwire 14. If materials other than nylon are selected as the primary constituent of the casing 12, it is contemplated that the ability of the material to lie flat against the wire 14 will be at least one parameter that is considered when selecting the alternative material. Still other parameters may be considered consistent with the discussion that follows and within the skill of those in the art.

As should be apparent to those skilled in the art, the casing 12 is not limited to a combination of nylon and spandex. Other materials and combinations of materials may be employed without departing from the scope of the present invention. These other materials include, inter alia, polymers and co-polymers, including polyamides, such as Kevlar (trademark) and Twaron (trademark), to name a few specific examples.

FIG. 1 also illustrates a sewn seam 18 that extends along a first edge 20 of the casing 12. For reference, the second edge 22 of the casing also is designated. It is noted that the terms "first" and "second," when referring to the edges 20, 22 are merely provided to differentiate one edge 20 from the other 22. In the discussion that follows, the first edge 20 also may be referred to as the "top" edge 20, and the second edge 22 may be referred to as the "bottom" edge 22. As should be apparent, the terms "top" and "bottom" refer to the orientation of the casing 12 that is designated in FIG. 1.

The seam 18, which is a sewn stitch, closes the casing 12 along the first edge 20 to encapsulate the underwire 14 therein. The seam 18 may be a continuous or discontinuous stitch, as should be apparent to those skilled in the art.

It is contemplated that the casing 12 will be formed by folding over the fabric 16 onto itself and sewing the mated edges 20 of the fabric 16 to one another, creating the single seam 18. It should be noted, however, that additional seams 18 may be incorporated into the casing 12 without departing from the scope of the present invention. For example, the seam 18 may be reinforced by an additional, parallel seam (not shown) sewn adjacent thereto.

While the present invention contemplates that the casing 12 will be made from a single ribbon of fabric 16 folded onto itself, the casing 12 may be made from plural ribbons (or pieces) of fabric 16 without departing from the scope of the present invention. If so, it is contemplated that the casing 12 may include one or more seams 18 along both of the first and second edges 20, 22. In this context, it is contemplated that the casing 12 may be made from two separate ribbons of fabric 16 that are sewn together, with seams 18 adjacent to the to the first and second edges 20, 22.

Regardless of the exact construction employed for the casing 12, the fabric 16 is contemplated to form a penetration barrier that retains the underwire 14 within the casing 12, while maintaining a desirable degree of flexibility.

In addition, the fabric is contemplated to be woven in a manner to increase the comfort fit associated with the encased wire 10. Specifically, it is contemplated that the fabric 16 of the casing 12 will define first and second regions with differing woven densities. A first woven region 24 is identified in FIG. 1. Two second woven regions 26 are designated in the same illustration. As is apparent from the illustration, the first woven region 24 is flanked on either side by the second woven regions 24.

With continued reference to FIG. 1, it is noted that a first delineation line 28 defines the transition between the first woven region 24 and the second woven region 26 adjacent to the first edge 20. Similarly, the second delineation line 30 identifies the transition between the first woven region 24 and the second woven region 26 adjacent to the second edge 22 of the casing 12. The first and second delineation lines 28, 30 are provided for reference and are not structural parts of the invention, as should be apparent.

It is contemplated that the two second woven regions 26 will incorporate a woven structure that provides a softer feel for the casing 12 adjacent to the first and second edges 20, 22. In this manner, it is contemplated that the wearer of a garment incorporating the encased wire 10 of the present invention will appreciate a softer feel to the edges 20, 22 of the encased wire 10.

With regard to the first woven region 24, it is contemplated that the fabric 16 will be more compactly (or densely) woven in this region. In the second woven regions 26, it is contemplated that the fabric 16 will be less densely woven. The more compact weave is contemplated to resist penetration by the underwire 14. The less dense weave is contemplated to provide a softer feel to the edges 20, 22 of the encased wire 10 of the present invention.

While a casing 12 with first and second woven regions 24, 26 is contemplated as one embodiment of the present invention, the present invention is not so limited. To the contrary, it is contemplated that the casing 12 may not include regions with different woven characteristics. To the contrary, a fabric 16 with a uniform weave may be employed without departing from the scope of the present invention.

Figure 2:
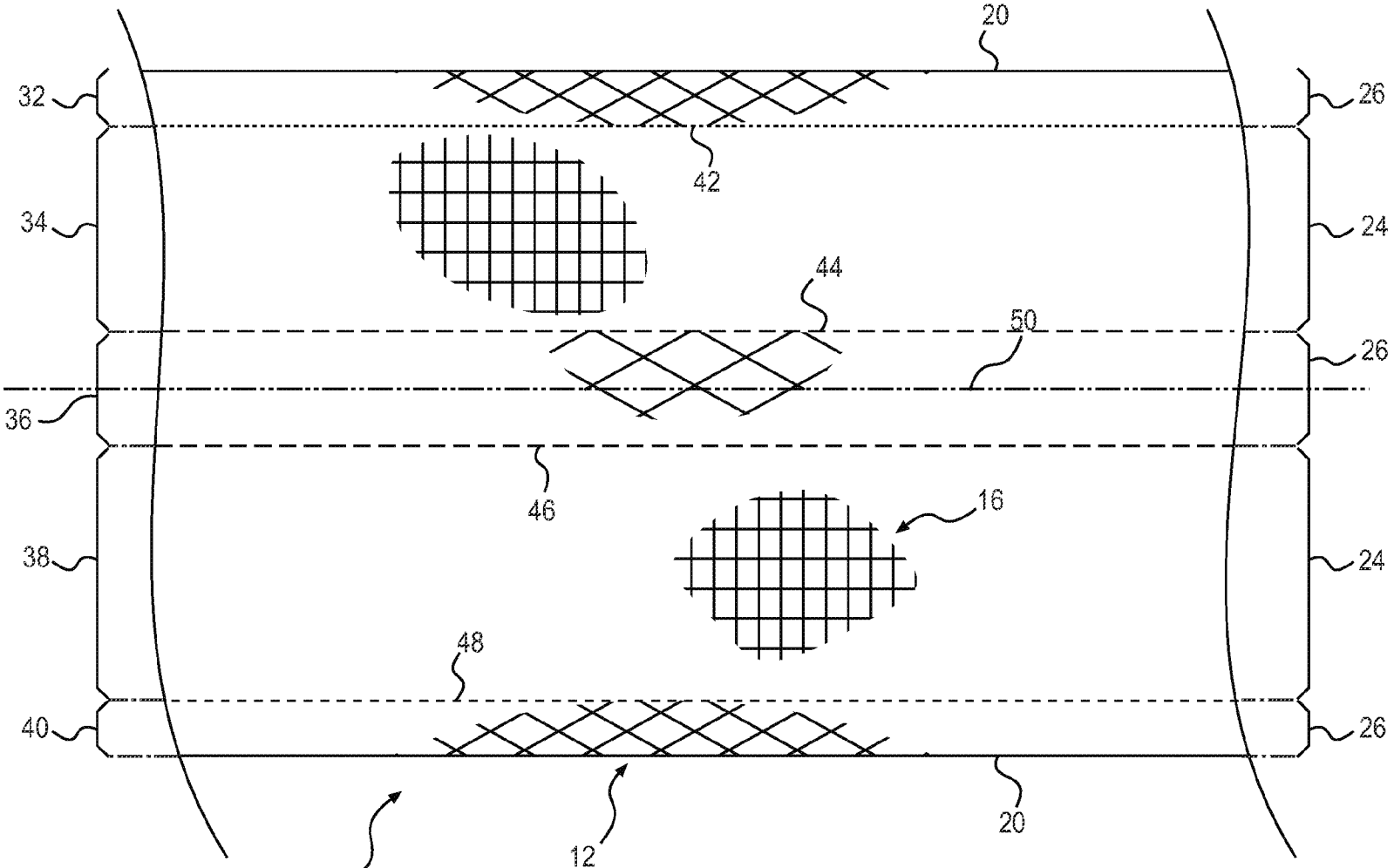
FIG. 2 is a top view of the casing illustrated in FIG. 1, shown in a condition before being sewn into the orientation illustrated in FIG. 1.

FIG. 2 is a top view of the casing 12 as it would appear when laid flat, prior to the sewing of the seam 18. This illustration provides a top view of a segment of the fabric ribbon 16 that is sewn closed to form the casing 12.

As is apparent, the fabric ribbon 16 defines five separate woven regions 32, 34, 36, 38, 40. The regions are separated from one another by delineation lines 42, 44, 46, 48. As a reference point, a fold line 50 also is shown. As discussed above, the delineation lines 42, 44, 46, 48 and the fold line 50 are not actual elements of the fabric ribbon 16. Instead, they are provided to facilitate discussion of the present invention.

While there are five woven regions 32, 34, 36, 38, 40 designated in FIG. 2, the woven regions 32, 34, 36, 38, 40 also may be categorized as being first woven regions 24 or second woven regions 26, as described above. Specifically, the regions 32, 36, and 40 are second woven regions 26. The regions 34 and 38 are first woven regions 24.

As noted above, during manufacture, the fabric ribbon 16 is folded onto itself to create the casing 12. FIG. 2 illustrates the location of the fold line 50 which defines the approximate location where the fabric ribbon 16 is folded onto itself. As should be apparent from FIG. 2, when the fabric ribbon 16 is folded onto itself, the first and second regions 24, 26 are placed into register with one another.

As also noted above, it is contemplated that the fabric ribbon 16 may be pre-assembled from two separate ribbons. If so, the two ribbons are anticipated to be connected to one another at a seam line located approximately at the location of the fold line 50.

Figure 3:
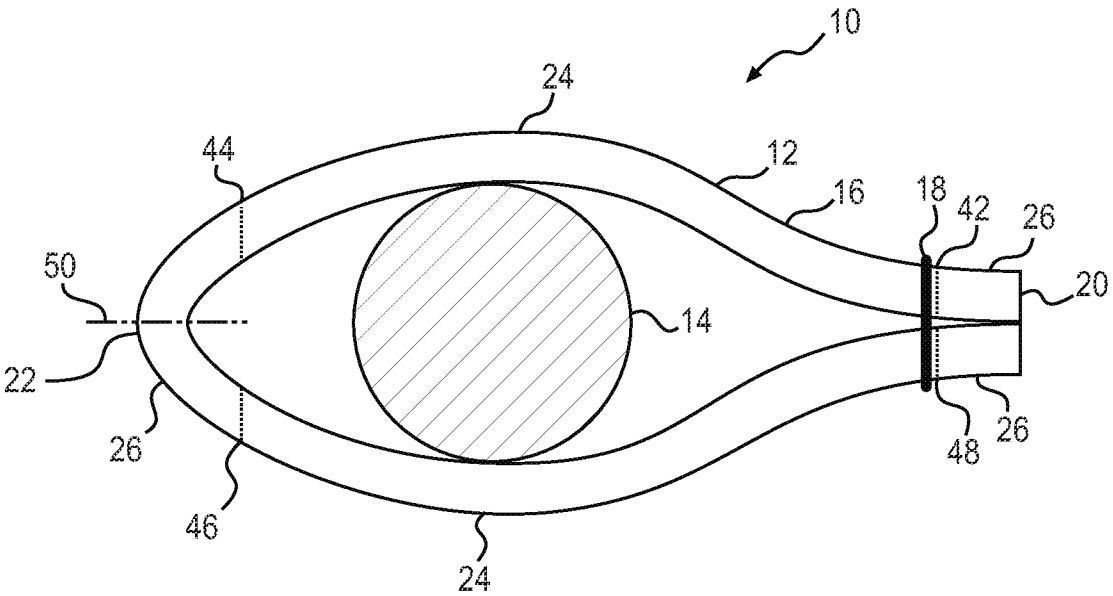
FIG. 3 is cross-sectional end view of the casing illustrated in FIG. 1.

FIG. 3 is a cross-sectional, end view of the encased wire 10 according to the first embodiment of the present invention. With the fabric ribbon 16 folded along the fold line 50 and sewn along the seam 18, the fabric ribbon 16 forms the casing 12 that encapsulates the underwire 14. The first and second woven regions 24, 26 are designated for clarity, as are the first and second edges 20, 22, among others of the features discussed above.

In FIG. 3, the underwire 14 is shown with a circular cross-section. It is noted that this shape is merely exemplary of one contemplated cross-sectional shape for the underwire 14. Other shapes may be employed without departing from the scope of the present invention. For example, the underwire 14 may have an oval, elliptical, asymmetric, angular, square, rectangular, triangular, polygonal, or other shape. While any shape may be employed for the underwire 14, it is contemplated that rounded shapes will be employed to increase the comfort associated with the encased wire 10.

In one embodiment, the underwire 14 is contemplated to be a single filament of material. The exact construction of the underwire 14, however, is not critical to the present invention. The underwire 14 may be made from a plurality of filaments that are stranded together without departing from the scope of the present invention.

The underwire 14 may be made from any suitable material, as should be understood by those skilled in the art. The underwire 14 may be made from metal, plastic, or composite materials, to name a few representative examples. Where metals are employed, it is contemplated that the metals may be pure metals or alloys. Suitable plastics include any of an enormous variety of polymer materials. Composite materials include combinations of materials such as carbon fibers embedded in resin. The recitation of specific materials is not intended to be limiting of the invention. Specific materials are identified to demonstrate the enormous breadth and scope of the present invention.

In connection with the encased wire 10, it has been determined that yarns textured for improved comfort and low shrinkage properties are better suited for the casing 12 of the present invention. One popular yarn is a 2 fold 78 dtex 24 filament Nylon 6 or Nylon 66. This yarn is intended to be exemplary of one specific embodiment of the present invention. This yarn is not required for the present invention, and its identification is not intended to be limiting of the present invention.

With respect to the casing 12, it is contemplated that the fabric 16 will have a dry tensile strength within a range of about 35.2 to 39.4 kg. Moreover, it is contemplated that the fabric 16 will have an average dry tensile strength of about 36.5 kg. Finally, it is contemplated that the fabric 16 will have a minimum, dry tensile strength of about 25.0 kg. While these values are exemplary of the properties contemplated for the fabric 16, other materials may be selected without departing from the scope of the present invention.

A popular way of forming yarns into a tubular fabric (such as the casing 12) is by a weaving process. In general, weaving produces a denser fabric than an equivalent knitting process. Also, a knitted fabric is typically less comfortable than a woven fabric due to its more open (i.e., loose) structure. As a result, woven fabrics are anticipated to for the fabric 16 from which the casing 12 is manufactured.

Weaving may be performed using a conventional narrow fabric loom. A preferred loom is produced by Jakob Muller AG, of Frick CHK-5070, Frick, Switzerland.

Figure 4:
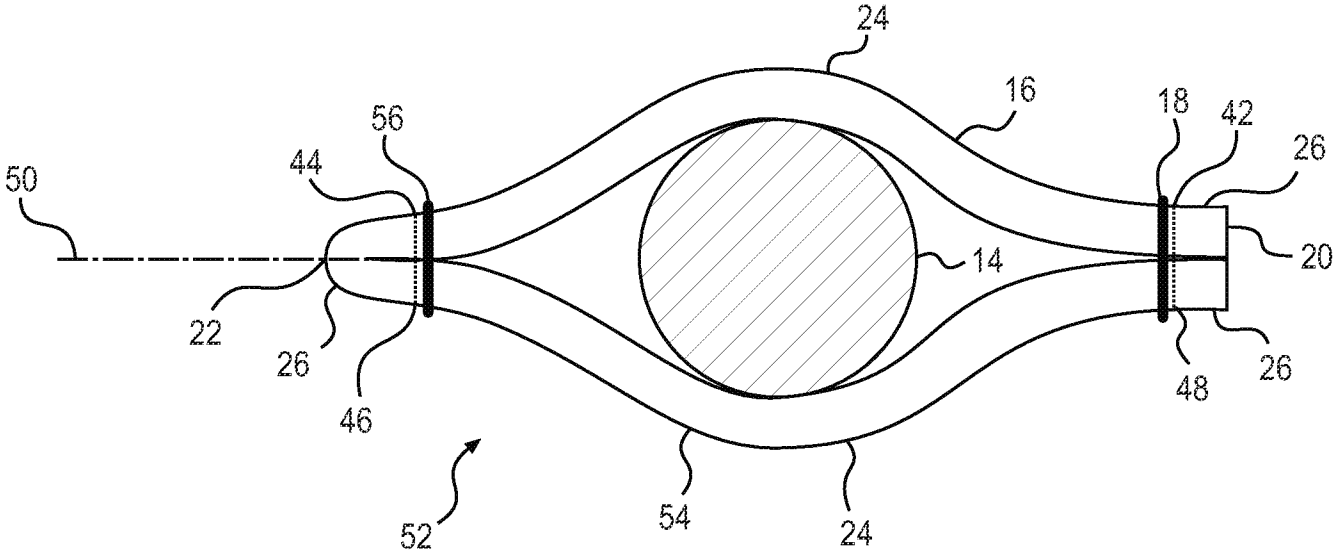
FIG. 4 is cross-sectional end view of a second embodiment of a casing according to the present invention.

FIG. 4 is a cross-sectional view of a second embodiment of an encased wire 52 of the present invention. In this illustration, the casing 54 is similar to the first embodiment illustrated in FIG. 3. In this embodiment, however, the casing 54 includes a second seam 56 that extends along the second edge 22 of the casing 52. Since features of this casing are similar to the casing 12 illustrated in the prior embodiment, reference numbers are repeated in this illustration for simplicity.

Figure 5:
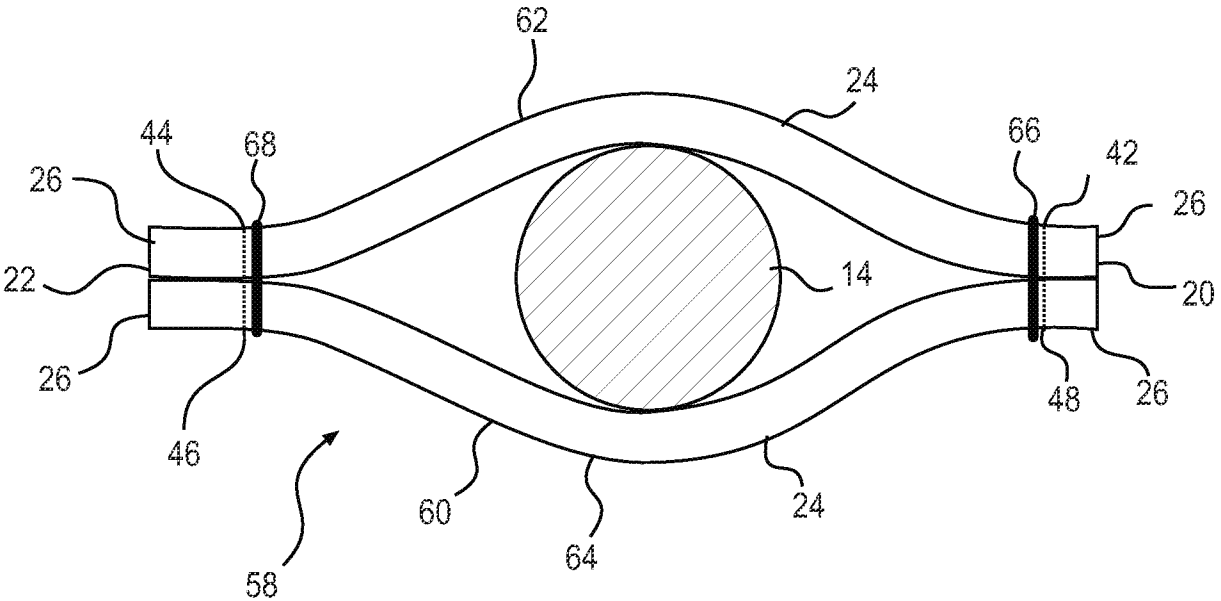
FIG. 5 is cross-sectional end view of a third embodiment of a casing according to the present invention.

FIG. 5 is a cross-sectional view of a third embodiment of an encased wire 58 according to the present invention. In this figure, the casing 60 is not folded around a fold line 50. Instead, as discussed above, the casing 60 is formed from two separate fabric ribbons 62, 64 that are joined at the seams 66, 68. As before, for simplicity, reference numbers are repeated for elements common to the other embodiments.

With continued reference to FIGS. 1-5, it is noted that the seams 18, 56, 66, 68 are each disposed within the first woven regions 24 of the casings 12, 54, 60. The positioning of the seams 18, 56, 66, 68 in the first woven regions 24 is not required to practice the present invention. The seams 18, 56, 66, 68 may be disposed within the second woven regions 26 without departing from the scope of the present invention.

As noted above, it is contemplated that the wire casing 12, 54, 60 comprises textured nylon and weft threads woven into one or more (i.e., two) fabric ribbons 16, 62, 64 which have strong resistance to penetration by the underwire 14. The fabric 16 is contemplated to have a grooved texture such that the one or two fabric ribbons 16, 62, 64 may be joined together. After joining, the top and bottom sides (first and second edges 20, 22) of the casings 12, 54, 60 are anticipated to be fixed and sewed together at the seams 18, 66, 68 by sewing machines with a predetermined operation. The end products are the casings 12, 54, 60.

The tensile strength of the casing 12, 54, 60 incorporated into the present invention resists penetration by the underwire 14. As indicated above, the tensile strength of the casing 12, 54, 60 of the present invention is contemplated to fall within a range of between about 35 and 39 kg, with a minimum tensile strength of about 25 kg.

While preparing the present invention, it was discovered that the tensile strength of the casing 12, 54, 60 of the present invention resists penetration by the underwire 14 to a much better degree than similar structures within the prior art. Laboratory tests suggest that conventional wire casings exhibit a tensile strength of between 15-20 kg. As noted, the casing 12, 54, 60 of the present invention exhibits a tensile strength of between about 35-39 kg, which is almost double the tensile strength of casing known in the prior art. As a result, the casing 12, 54, 60 of the present invention is understood to be about twice as effective for resisting penetration by the underwire 14 than comparative prior art casings.

It is contemplated that the casing 12, 54, 60 will have a total width, as measured between the first and second edges 20, 22 of about 10 mm±1 mm, with the effective width (excluding any frill) of about 10 mm. The warp yarn may be one or both of 78/24F/2 Twist Polyamide and/or 78/24F/1 Polyamide with an elastomer such as 311 Spandex covered by 44/1 Polyamide and a weight of 10.89 g/m±10%. The weft yarn may be 78/18F/1 Twist S.D Polyamide. The material is contemplated to have finished ends (picks)/course (wales) per cm of 27±3. The material also is contemplated to have the following joins per 100 m (maximum): 4 joins (for white and pastel colors) and 5 joins (for dark colors). The material is contemplated to satisfy the Marks & Spencer Standard C4A-C6-C7-C8. As a result, the material is contemplated to conform to the Marks & Spencer Children-wear Metal Detection Policy. As such, the material will comply with the Marks & Spencer Environmental Code of Practice for dyeing, printing and finishing, including German consumer legislation. As should be apparent, the material also is contemplated to comply with other local, national and international standards that are similar to or parallel to these stated standards.

Figure 6:
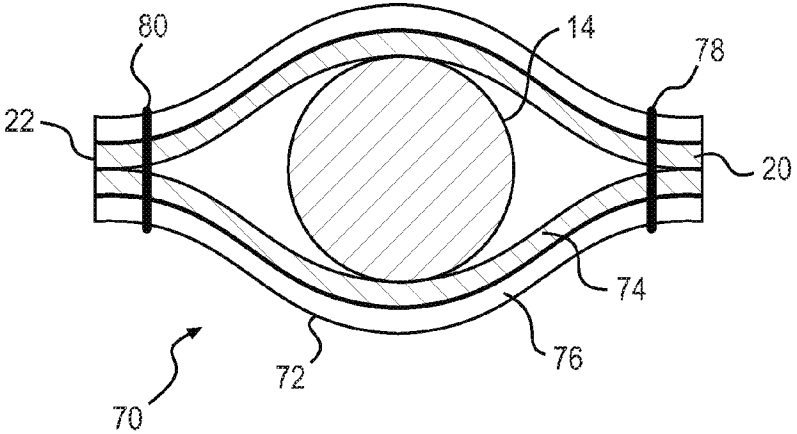
FIG. 6 is cross-sectional end view of a fourth embodiment of a casing according to the present invention.

FIG. 6 provides a cross-sectional view of a fourth embodiment of an encased underwire 70 of the present invention. Here, the casing 72 is formed with two layers of fabric positioned adjacent to one another. The first fabric 74 is the inner fabric layer and the second fabric 76 is the outer fabric layer. The outer fabric layer 76 defines the outer surface of the casing 72. In this embodiment, which is similar to the third embodiment illustrated in FIG. 5, there are two seams 78, 80 that are disposed adjacent to the first and second edges 20, 22 of the casing 72. The underwire 11 is shown in this view, as in the prior views.

The first fabric layer 74 is constructed such that there is an absence of excessive fibers woven into it. As such, the first (or inner) fabric layer 74 layer provides a strong structure that may be combined into lingerie (specifically the chest cup) without any gaps (or with very small gaps) in the weave forming the structure. In this manner, the first fabric layer 74 provides a woven fabric that resists penetration by the encased wire 14. The first fabric layer 74, therefore, share characteristics with the first woven region 24 as discussed above.

The second fabric layer 76 is the external layer and, as such, has the potential for directly contacting the wearer's skin. As a result, the second fabric layer 76 (or outer fabric layer) is constructed to provide comfort to the wearer. To provide comfort, the second fabric layer 76 is woven to provide a soft surface. One way in which this is accomplished is for second fabric layer 76 to be provided with a lower density of fibers. In other words, a lower number of fibers are incorporated into the second fabric layer 76 to provide a softer surface than are provided for the first fabric layer 74, which is designed to resist penetration by the encased wire 14. As should be apparent, the second fabric layer 76 shares characteristics of the second fabric region 26 described above.

In addition, because the second fabric layer 76 is designed for contact with the wearer's skin, the second fabric layer 76 may be constructed from (or may incorporate) materials that are moisture absorbent. So that moisture does not accumulate in the second fabric layer 76, the second fabric layer 76 also may be constructed from a fabric that permits a rapid dissipation of moisture (i.e., perspiration) from the casing 72. Moreover, the second fabric layer 76 may be made from a material that is gas-permeable.

In connection with the property of water absorption and dissipation, materials that are contemplated for the second fabric layer 76 are referred to as materials that facilitate wicking of moisture. As is known in the art, such materials provide the benefit of removing moisture from a person's skin and allowing the moisture to evaporate more rapidly than non-wicking materials.

It is noted that, while the second fabric layer 76 is described as being made from a wicking material, the first fabric layer 74 also may be constructed, either partially or wholly, from a similar material. As a result, the casing 72, which combines the two layers 71, 76, discourages the accumulation of water therein.

With respect to the fourth embodiment of the casing 72 of the present invention, it is noted that aspects from the first through third embodiments also may be incorporated therein without departing from the scope of the present invention. For example, the combination of first fabric layer 74 and the second fabric layer 76 may be preformed into a ribbon. Two such ribbons may be sewn together and then folded around the underwire 14, as discussed above.

Figure 7:
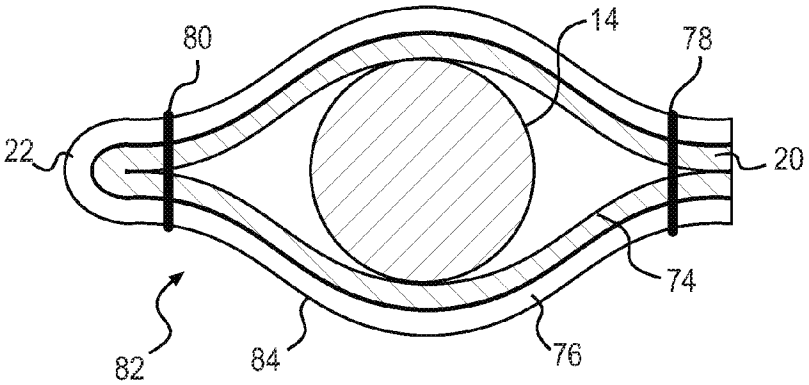
FIG. 7 is cross-sectional end view of a fifth embodiment of a casing according to the present invention.

FIG. 7 is a cross-sectional illustration of a fifth embodiment of an encased wire 82. The casing is designated 84. This embodiment of the encased wire 82 incorporates first and second fabric layers 74, 76, as in the embodiment illustrated in FIG. 6. In this embodiment, however, the second end 22 includes a folded end, similar to the embodiment illustrated in FIG. 4.

Figure 8:
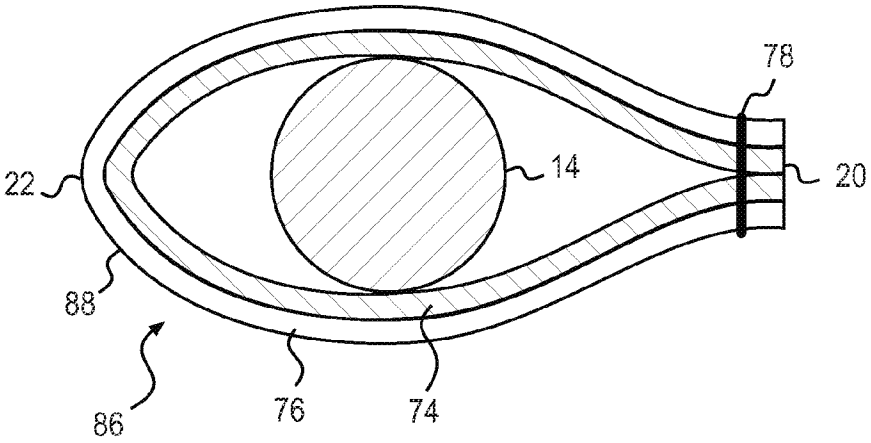
FIG. 8 is cross-sectional end view of a sixth embodiment of a casing according to the present invention.

FIG. 8 is a cross-sectional illustration of a sixth embodiment of an encased wire 86 according to the present invention. A casing 88 is shown. The casing 88 includes the double-layer construction as discussed in connection with FIG. 6. In this embodiment, the second end 22 excludes a seam, which is similar to the embodiment illustrated in FIG. 3.

Figure 9:
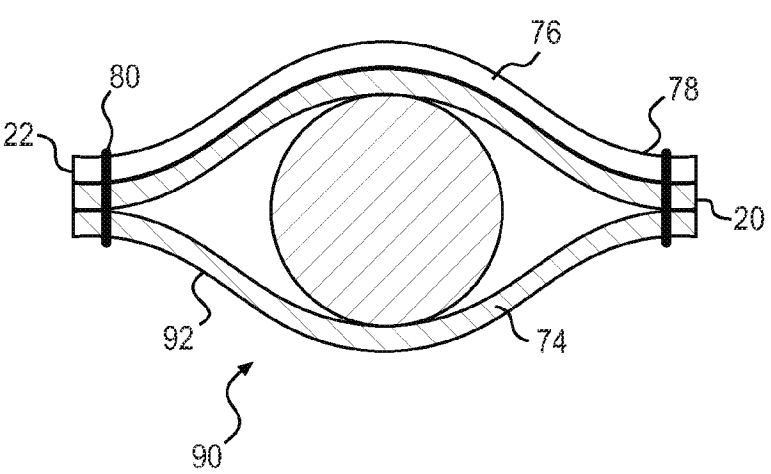
FIG. 9 is cross-sectional end view of a seventh embodiment of a casing according to the present invention.

FIG. 9 is a cross-sectional illustration of a seventh embodiment of an encased wire 90 according to the present invention. In this embodiment, the casing 92 is asymmetrical. Specifically, the second fabric layer 76 is omitted from one side of the casing 92. For this embodiment, it is anticipated that the side of the casing 92 that excludes the second fabric layer 76 will not be positioned to rest against the user's skin. The side of the casing 92 that includes the second fabric layer 76 will be positioned such that it is in contact with the user's skin.

As should be apparent from the foregoing, there are numerous variations associated with the present invention. Features of one embodiment may be combined with features of other embodiments without departing from the scope of the present invention, as should be apparent to those skilled in the art.

Aspects of the production and/or manufacture of the casing of the present invention will now be discussed in connection with the casing 70, which is illustrated in FIG. 6. While the following discussion focuses on the manufacture of the casing 70, the same manufacturing techniques and steps may be applied to any of the remaining embodiments without departing from the scope of the present invention.

To produce the casing 70, the present invention combines both an improved sewing machine and also a method of manufacture of the casing 70, the details of which are summarized in the paragraphs that follow.

Specifically, a sewing machine 100 has been developed that differs from sewing machines that are generally known in the prior art. FIGS. 10-15 provide various views of one embodiment of a sewing machine 100 according to the present invention.

With respect to the sewing machine 100, a casing fixture 102 is provided on the sewing machine 100 to hold the first and second fabric layers 74, 76 in register with one another and to facilitate sewing of the layers 74, 76 to one another along the seams 78, 80. The casing fixture 102 also facilitates automatic sewing of the casing 72 into a tubular structure by folding the first and second fabric layers 74, 76 onto one another prior to and during the travel of the two layers 74, 76 through the sewing machine 100. Specifically, the casing fixture 102 folds the layers 74, 76 and feeds the folded layers into the sewing machine 100 so that the needle 104 is able to sew the layers 100 together to form the tubular casing 72.In this manner, it is possible to create a continuous (or nearly continuous) casing 72 that may be used to construct the brassiere, lingerie, or other garment requiring an encased wire 70.

As should be appreciated, by providing the casing fixture 102 on the sewing machine 100, it is possible to manufacture the casing 72 in an automated or semi-automated fashion, thereby increasing the speed of manufacture and reducing the cost of production, among other advantages.

As should be apparent, the present invention contemplates different constructions for the casing fixture 102 that is attached to a sewing machine 100. The different embodiments accommodate different fabric types and sizes, the details of which depend on the parameters associated with the garment to be constructed therefrom.

In one embodiment, the wire casing is 10 mm in width in its final dimension. As such, the casing fixture 102 incorporates a guide that is 20 mm in width to accommodate the first and second fabric layers 74, 76 before they are folded over and sewn to one another. As noted, the casing fixture 102 folds the layers 74, 76 onto one another prior to the sewing operation.

As should be immediately apparent, the dimensions of the first and second fabric layers 74, 76 and the casing fixture 102 may differ without departing from the present invention. Specifically, the dimensions may be greater than or smaller than 10 mm without departing from the scope of the present invention.

Next, the stitch contemplated to secure the first and second fabric layers 74, 76 to one another, along the seams 78, 80, may be what is referred to as an "Organ 10" stitch. Still other stitch types maybe employed without departing from the present invention.

Further details concerning the sewing machine 100 of the present invention and its operation are provided in connection with FIGS. 10-15.

Figure 10:
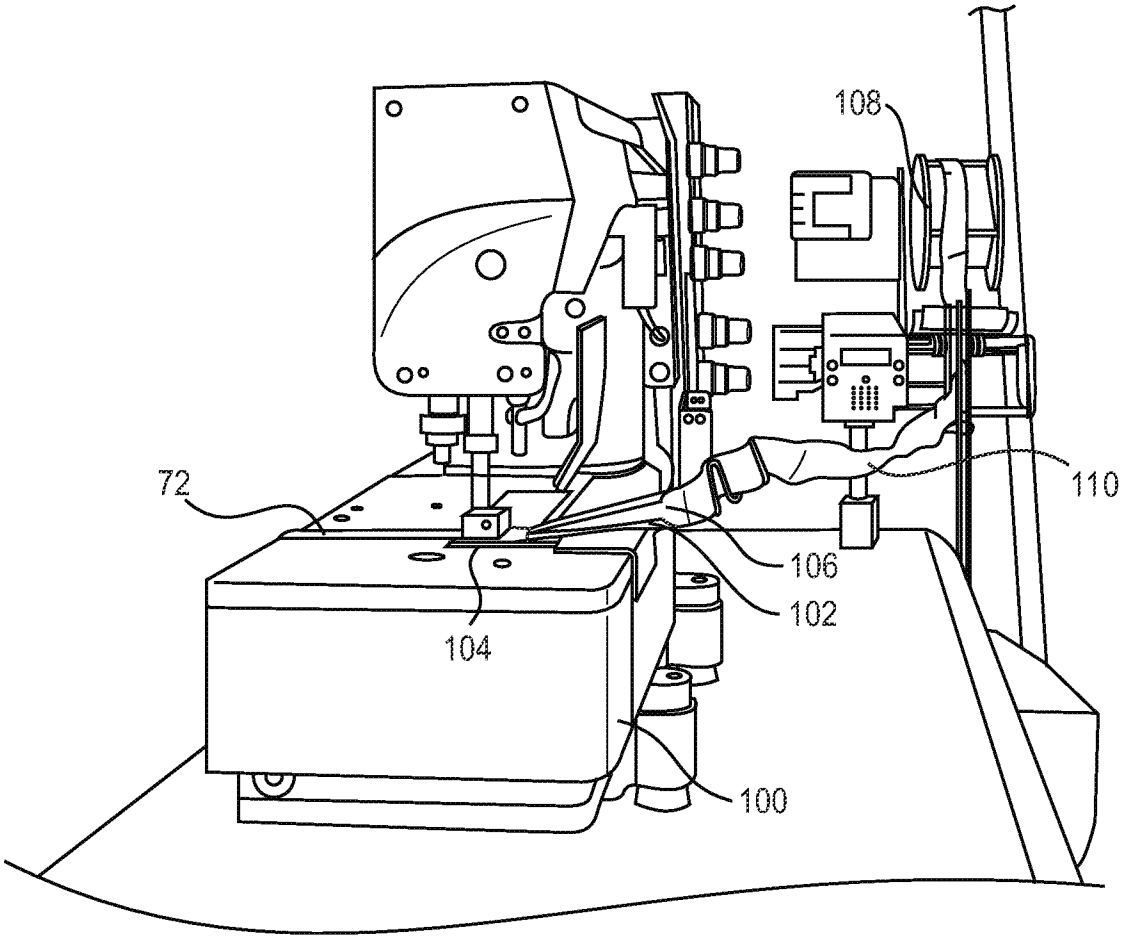
FIG. 10 is a perspective view of a sewing machine according to the present invention.

FIG. 10 is an end view of the sewing machine 100 according to the present invention. The sewing machine 100 includes a casing guide 106, which is part of the casing fixture 102 attached to the sewing machine 100. The casing guide 106 folds the pre-sewn casing 110 before introducing the pre-sewn casing 110 to the needle 104. In FIG. 10, the pre-sewn casing 110 is shown being spooled from a feeding reel 108. The sewn casing 72 is also visible leaving the needle 104.

As a point of reference, the pre-sewn casing 110 incorporates two parallel ribbons, each including the first and second fabric layers 74, 76 in the proper orientation. The two parallel ribbons may be attached to one another along a seam, which may be a stitched seam.

Figure 11:
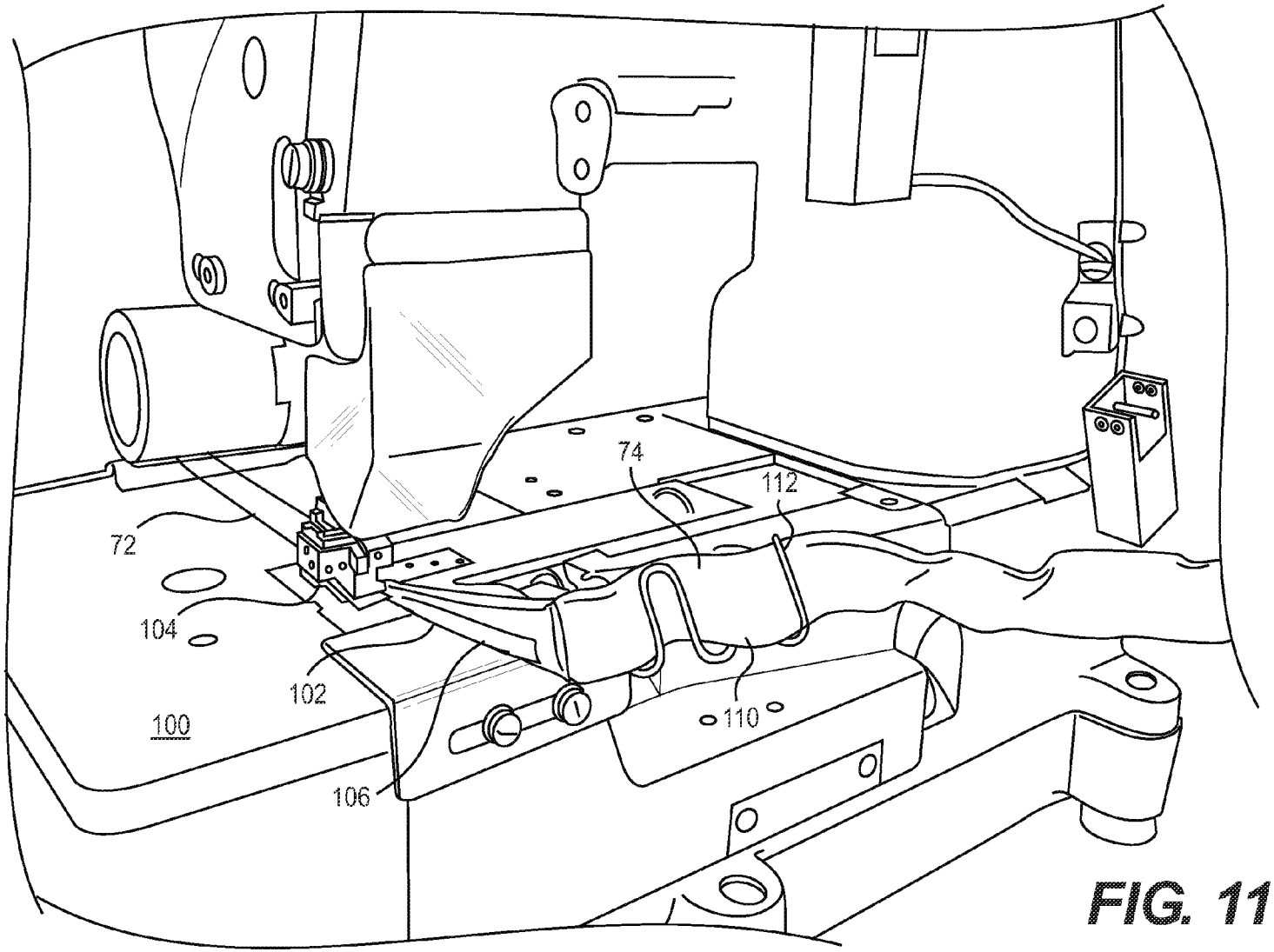
FIG. 11 is an enlarged perspective view of the sewing machine illustrated in FIG. 10, showing a casing guide.

FIG. 11 is an enlarged view of a portion of the sewing machine 100 of the present invention shown in FIG. 10. The casing fixture 102 is shown with increased detail in this view. As is apparent from this view, the casing fixture 102 incorporates the casing guide 106 therein. In this embodiment, the casing guide 106 is a metal, U-shaped structure into which the pre-sewn casing 110 is inputted. The casing guide 106 is configured to fold the pre-sewn casing 110 into a configuration to form the sewn casing 72.

FIG. 11 also illustrates a feeder 112 that is connected to the casing guide 106. The feeder 112 is a sinusoidally-shaped wire element through which the pre-sewn casing 110 is threaded. The feeder 112 assures that the pre-sewn casing 110 is in the proper orientation so that it may be folded properly by the casing guide 106. The feeder 112 also assures that the second fabric layer 76 layer will form the exterior surface of the sewn casing 72. Specifically, with the second fabric layer 76 facing away from the casing guide 106, the second fabric layer 76 will become the exterior surface of the casing 72 after being folded by the casing guide 106.

Figure 12:
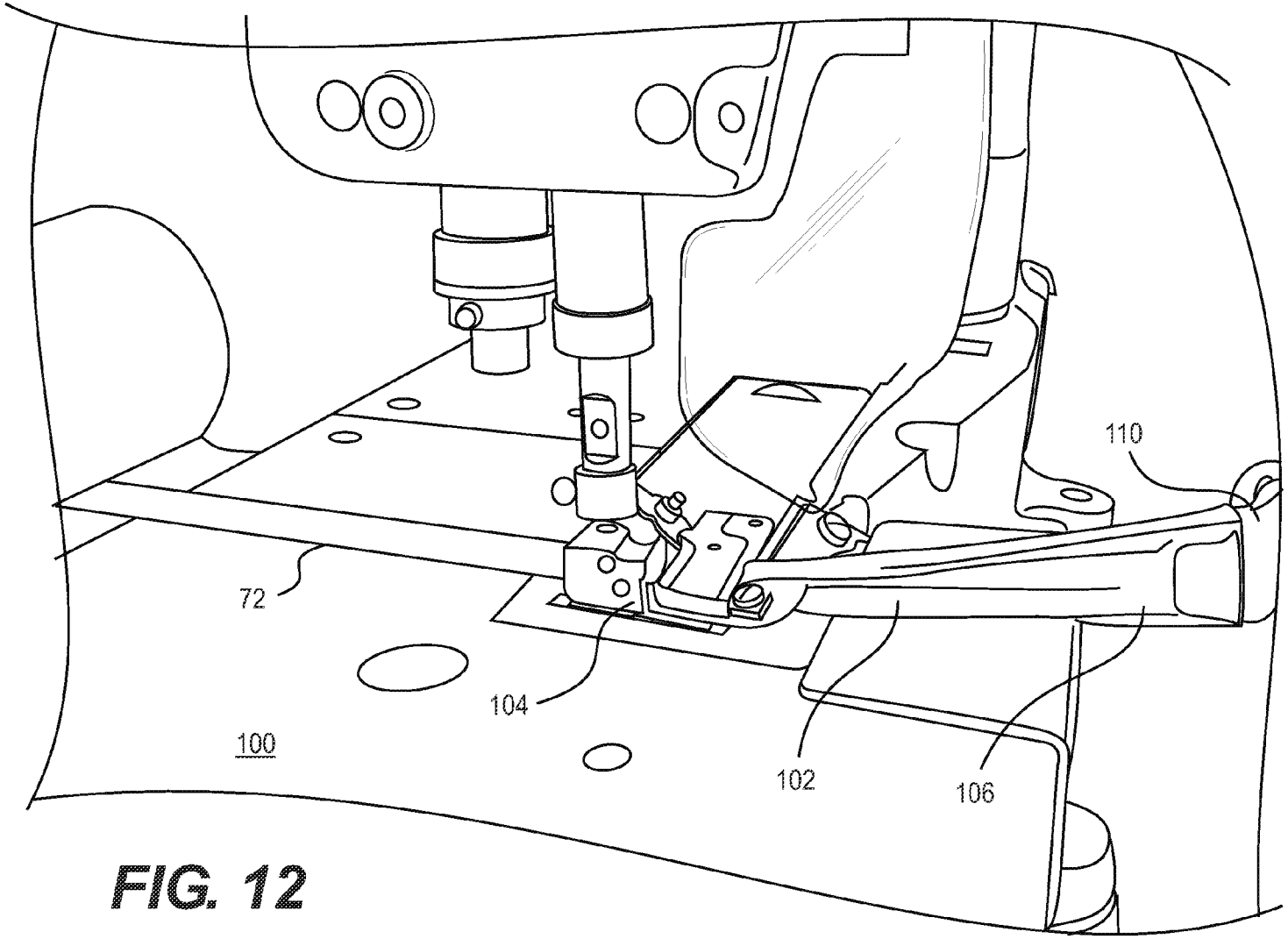
FIG. 12 is a further, enlarged view of the sewing machine shown in FIG. 11.

FIG. 12 is a further, enlarged view of the casing guide 106 attached to the sewing machine 100 of the present invention. The U-shape of the casing guide 106 may be better appreciated from this illustration.

Figure 13:
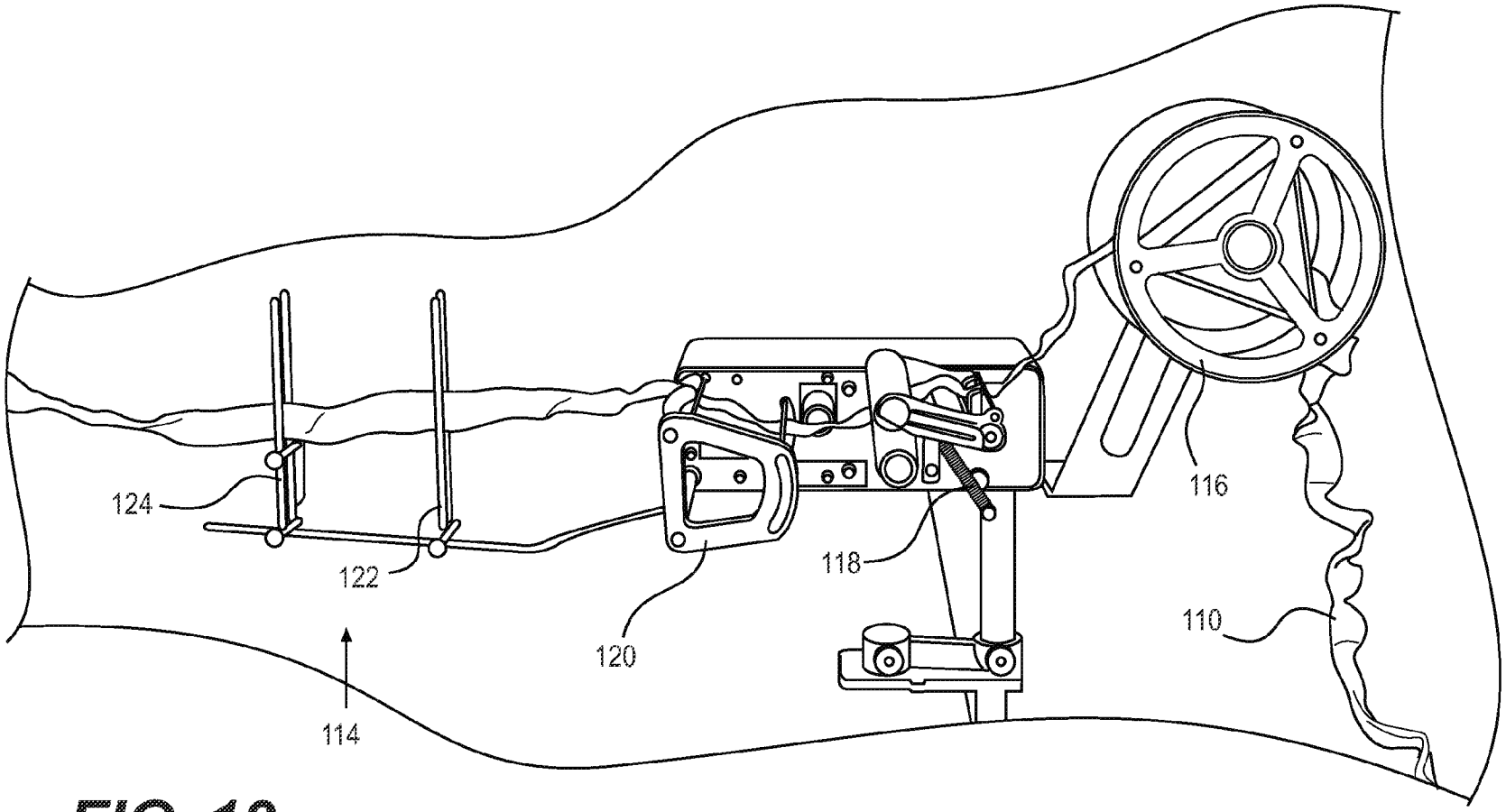
FIG. 13 is a side view of the feeder elements that form a part of the sewing machine of the present invention.

FIG. 13 is a side view of feeder elements 114 that are connected to the sewing machine 100 of the present invention and form a part thereof. In this side view, a feeder reel 116 is shown. The pre-sewn casing 110 travels over the feeder reel 116 and passes through a first alignment device 118 and a second alignment device 120. The two alignment devices 118, 124 assure that the pre-sewn casing 110 is in a proper orientation prior to being sewn to form the sewn casing 72. The alignment devices 118, 120 assure, for example, that the second fabric layer 76 is oriented such that, after folding, the second fabric layer 76 layer is on the exterior side of the sewn casing 72.

FIG. 13 also illustrates two vertical alignment devices 122, 124, which hold the pre-sewn casing 110 in a vertical orientation for proper threading into the casing guide 106. Consistent with the orientation of the pre-sewn casing 110, the first fabric layer 74 is visible in this view.

Figure 14:
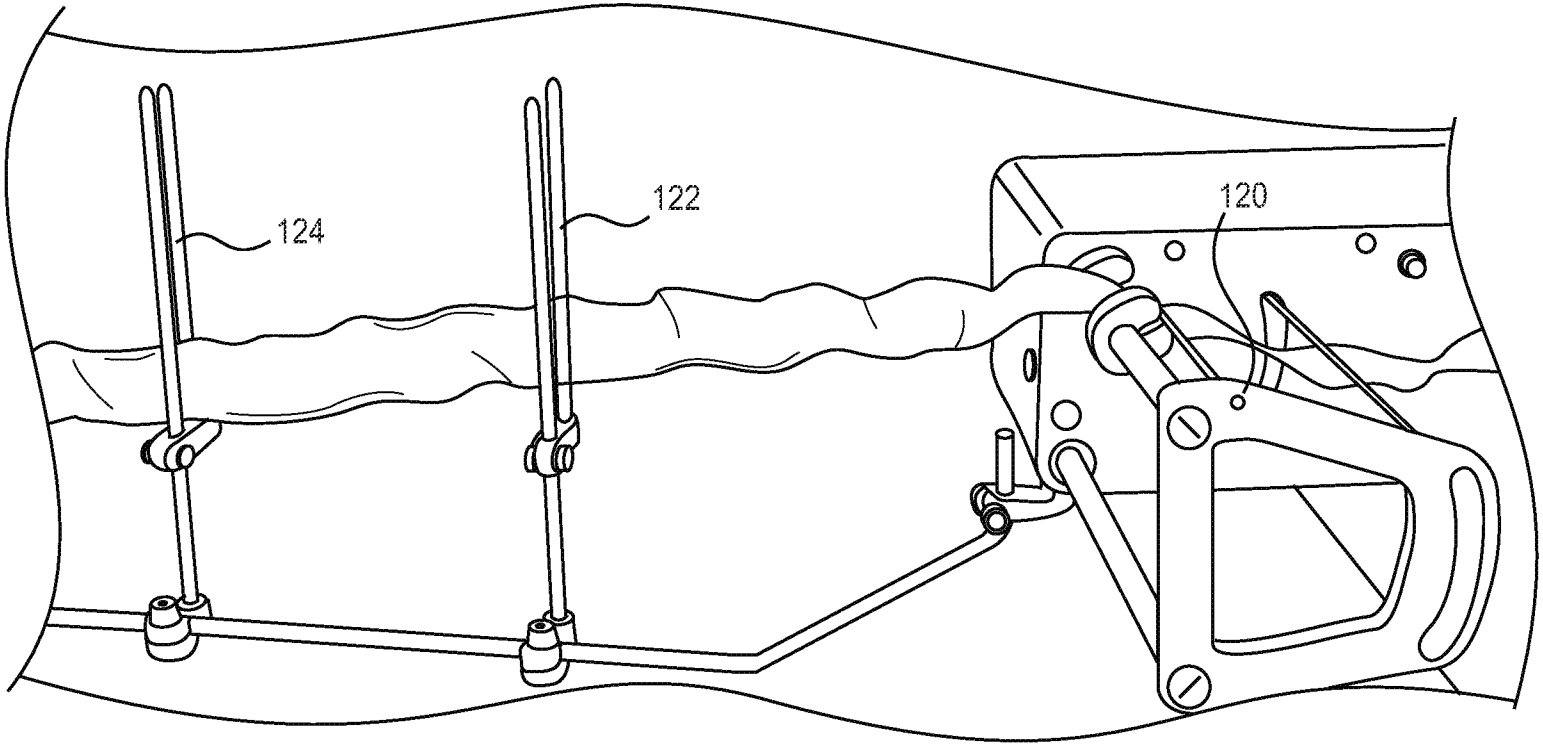
FIG. 14 is an enlarged view of some of the feeder elements shown in FIG. 13.

FIG. 14 is an enlarged, detailed view of some of the feeder elements 114 of the sewing machine 100 of the present invention. Specifically, this view shows the vertical alignment devices 122, 124 in greater detail.

Figure 15:
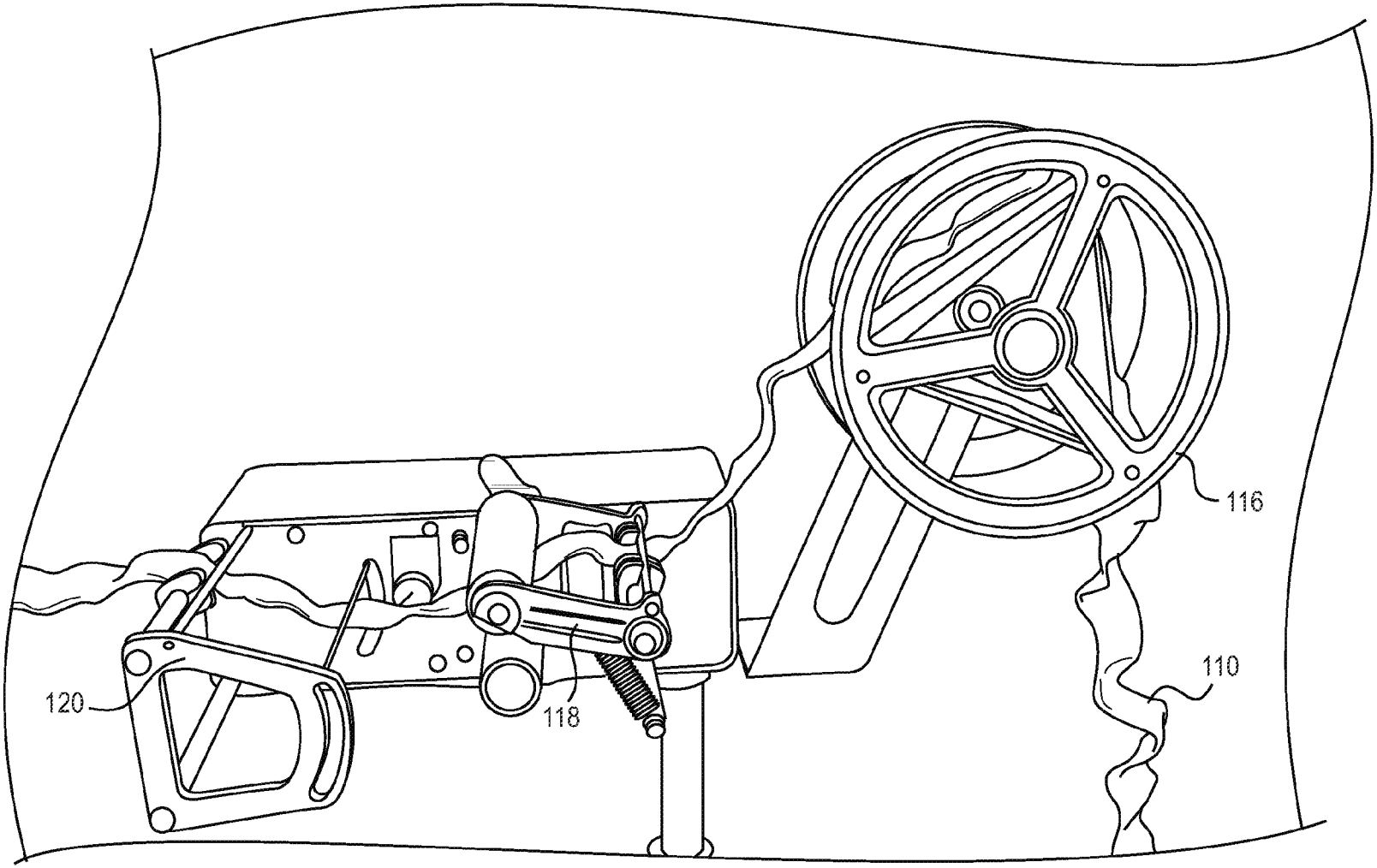
FIG. 15 is an enlarged view of the remainder of feeder elements shown in FIG. 13.

FIG. 15 is an enlarged, detailed view of some of the feeder elements 114 of the sewing machine 100 of the present invention. In this view, the feeder reel 116 and the two alignment devices 118, 120 are shown in greater detail.

Figure 16:
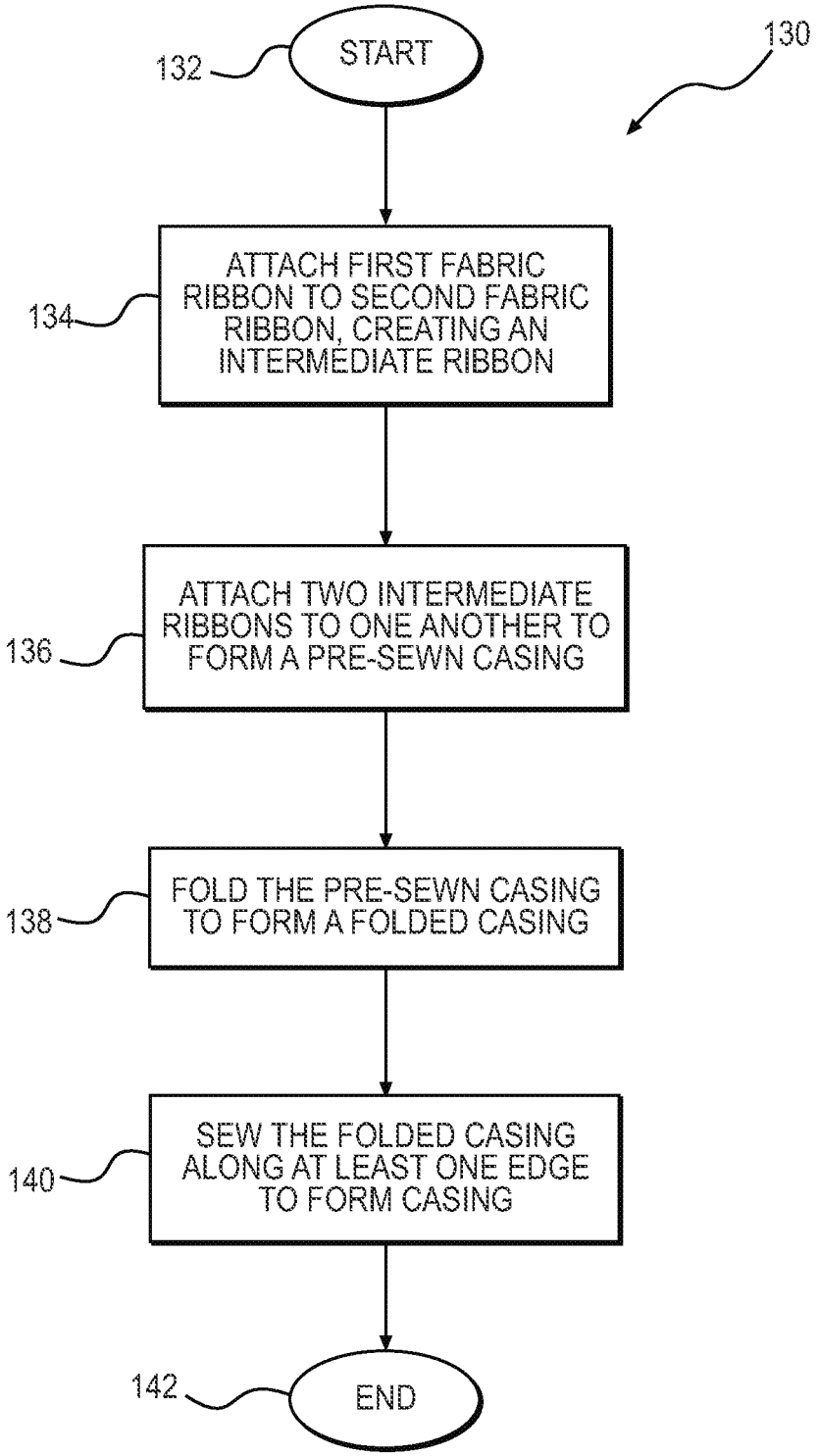
FIG. 16 is a graphical depiction of one method for forming a casing according to the present invention.

FIG. 16 is a graphic illustration of a method contemplated as a part of the present invention. Specifically, the graphical illustration identifies selected steps in the manufacture of the casing 72, which steps are detailed below. While the method will be described in connection with the manufacture of the casing 72, the method is intended to apply to any of the embodiments described herein.

The method is designated as 130 in FIG. 16. The method begins at step 132. The method then proceeds to step 134 where a ribbon of the first fabric material 74 is attached to a ribbon of the second fabric material 76. The ribbon of the first fabric material 74 may be attached to the ribbon of the second fabric material 76 by sewing or any other attachment means known to those skilled in the art. Attachment of the first and second fabric materials 74, 76 to one another creates a first intermediate fabric ribbon.

After step 134, the method proceeds to step 136 where two intermediate fabric ribbons are joined to one another to form the pre-sewn casing 110. After this step, the first fabric material 74 will essentially form one side of the pre-sewn casing and the second fabric material 76 will form the other side of the pre-sewn casing 110.

At step 138, the pre-sewn casing is fed into the casing guide 106, which folds the pre-sewn casing 110 so that the first fabric material 74 is positioned on the inside of the folded casing structure. The folded casing structure is then fed to sewing machine 100.

At step 140, the folded casing structure is sewn along at least one of the edges 20, 22 to form the casing 72. The method 130 ends at step 142.

As should be apparent, for embodiments of the casing that do not have a bilayer construction, the method begins at steps 136 or 138, depending upon the construction of the casing.

As also should be apparent, after the casing 72 is formed, the underwire 14 may be inserted therein to complete the encased wire structure 70.

As should be apparent from the foregoing, different materials and dimensions for the various elements of the present invention may be employed without departing from the present invention. Moreover, the details for specific embodiments are intended to be exemplary of the scope of the present invention and are not intended to be limiting thereof.

What is claimed is:

1. An encased wire for a garment, comprising:

a wire with first and second ends; and a casing surrounding the wire, wherein the casing comprises at least one first fabric ribbon woven from a polyamide, wherein the casing has a first side edge, a second side edge, and at least a first, stitched seam disposed adjacent to the first side edge to close the casing, thereby containing the wire, wherein the casing comprises at least one first woven region and at least one second woven region, wherein at least a portion of said at least one first fabric ribbon comprises said at least one first woven region, wherein at least a portion of at least one of said at least one first fabric ribbon and a second fabric ribbon comprises said at least one second woven region, wherein said at least one first woven region comprises a first woven density that resists penetration by at least one of the first and second ends of the wire, wherein said at least one first woven region is in contact with the wire, wherein said at least one second woven region comprises a second woven density that is configured to provide increased comfort to a wearer of the garment incorporating the wire, wherein said at least one first woven region is disposed between the wire and said at least one second woven region, thereby separating the wire from said at least one second woven region, and wherein the first woven density is greater than the second woven density.

2. The encased wire of claim 1, wherein said at least one first fabric ribbon is folded along a fold line, and wherein the fold line defines the second side edge of the casing.

3. The encased wire of claim 2, further comprising: a second, stitched seam disposed adjacent to the second side edge.

4. The encased wire of claim 1, wherein:

said at least one second woven region comprises two second woven regions, each being adjacent to the first edge and the second edge, respectively, and said at least one first woven region is between the two second woven regions.

5. The encased wire of claim 1, further comprising:

a second, stitched seam disposed adjacent to the second side edge.

6. The encased wire of claim 1, further comprising:

a second, stitched seam disposed adjacent to the second side edge, wherein said at least one first fabric ribbon and said at least one second fabric ribbon are connected to one another via the first and second stitched seams adjacent to the first and second side edges, and wherein said at least one second fabric ribbon is woven from a polyamide.

7. The encased wire of claim 6, further comprising:

a third fabric ribbon disposed atop and attached to said at least one first fabric ribbon, wherein at least a portion of the third fabric ribbon comprising a third woven region comprising the same properties of said at least one second woven region.

8. The encased wire of claim 7, further comprising:

a fourth fabric ribbon disposed atop and attached to said at least one second fabric ribbon, wherein at least a portion of the fourth fabric ribbon comprising a fourth woven region comprising the same properties of said at least one second woven region.

9. The encased wire of claim 1, wherein the polyamide is nylon.

10. The encased wire of claim 1, wherein the casing comprises a polyamide and a polyurethane-polyurea copolymer.

11. The encased wire of claim 10, wherein the polyamide is nylon and the polyurethane-polyurea copolymer is spandex.

12. The encased wire of claim 11, wherein the casing comprises 95.6% nylon and 4.4% spandex.

13. The encased wire of claim 11, wherein the casing comprises 96.8% nylon and 3.2% spandex.

14. The encased wire of claim 11, wherein the casing comprises a material that wicks moisture.

15. The encased wire of claim 11, wherein the wire is suitable for an underwire for a brassiere.

16. A method of forming an encased wire for a garment, comprising:

folding at least one first fabric ribbon woven from a polyamide to form a casing, wherein the casing has a first side edge and a second side edge;

sewing at least a first, stitched seam disposed adjacent to the first side edge to close the casing; and disposing a wire with first and second ends within the casing;

wherein the casing comprises at least one first woven region and one second woven region, wherein at least a portion of the at least one first fabric ribbon comprises the at least one first woven region, wherein at least a portion of the at least one first fabric ribbon also comprises the at least one second woven region, wherein the at least one first woven region comprises a first woven density that resists penetration by at least one of the first and second ends of the wire, wherein the at least one first woven region is in contact with the wire, wherein the at least one second woven region comprises a second woven density that is configured to provide increased comfort to a wearer of the garment incorporating the wire, wherein the at least one first woven region is disposed between the wire and the at least one second woven region, thereby separating the wire from the at least one second woven region, and wherein the first woven density is greater than the second woven density.

17. The method of claim 16, further comprising:

sewing at least a second, stitched seam disposed adjacent to the second side edge.

18. A method of forming a casing for an encased wire for a garment, comprising:

providing at least one first fabric ribbon woven from a polyamide to form at least a part of the casing, wherein the casing has a first side edge and a second side edge;

providing at least a second fabric ribbon woven from a polyamide to form at least a part of the casing;

sewing at least a first, stitched seam disposed adjacent to the first side edge;

sewing at least a second, stitched seam disposed adjacent to the second side edge, thereby closing the casing; and disposing a wire with first and second ends in the casing;

wherein the casing defines at least one first woven region comprising a first woven density that resists penetration by at least one of the first and second ends of the wire, wherein the casing defines at least one second woven region comprising at least one second woven density that is configured to provide increased comfort to a wearer of the garment incorporating the wire, wherein at least a portion of the at least one first fabric ribbon comprises the at least one first woven region, wherein at least a portion of the second fabric ribbon comprises the at least one second woven region, wherein the at least one first woven region is in contact with the wire, wherein the at least one first woven region is disposed between the wire and the at least one second woven region, thereby separating the wire from the at least one second woven region, and wherein the first woven density is greater than the second woven density.

* * * * *